United States Patent [19]

Drevet

[11] 4,059,062

[45] Nov. 22, 1977

[54] SEWING MACHINE HAVING A DUAL-PURPOSE COMPLEMENTARY CASE

[76] Inventor: Georges Drevet, 24 Rue Francisque Vovtier, 42100 Saint-Etienne, Loire, France

[21] Appl. No.: 636,952

[22] Filed: Dec. 2, 1975

Related U.S. Application Data

[62] Division of Ser. No. 368,686, June 11, 1973.

[30] Foreign Application Priority Data

| | | |
|---|---|---|
| June 12, 1972 | France | 72.21520 |
| Mar. 14, 1973 | France | 73.09815 |

[51] Int. Cl.[2] ..... D05B 75/00

[52] U.S. Cl. ..... 112/258

[58] Field of Search ..... 112/258, 260, 217.1; 312/208, 24

[56] References Cited

U.S. PATENT DOCUMENTS

| | | | |
|---|---|---|---|
| 2,247,383 | 7/1941 | Hohmann et al. | 112/260 |
| 2,656,805 | 10/1953 | Reinhold | 112/258 |
| 3,552,340 | 1/1971 | Fresard | 112/258 |
| 3,570,430 | 3/1971 | Fresard | 112/258 |
| 3,744,443 | 7/1973 | Current | 112/258 |

*Primary Examiner*—George H. Krizmanich

[57] ABSTRACT

A sewing machine of the cantilever type designed so as to be compact, of light-weight, exceptionally functional and of attractive appearance, while at the same time incorporating other significant practical advantages. The inventive sewing machine comprises a closely complementary-shaped fitted case of the "attache case" type, facilitating on the one hand the convenient conveyance of the machine and on the other hand, the removal thereof, when not utilized, with a minimum extent of bulk. During utilization of the machine, the case may be fastened by pivotal motion to a cantilevered or free arm of the machine so as to form a large-dimensioned worktable.

11 Claims, 29 Drawing Figures

FIG.6
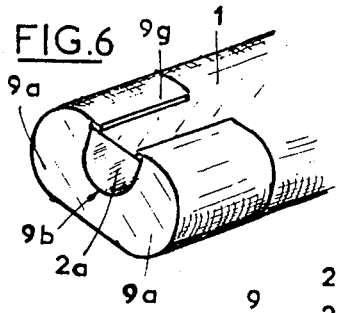
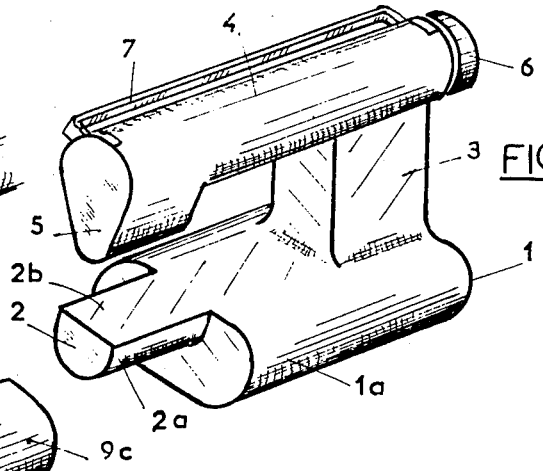
FIG.4
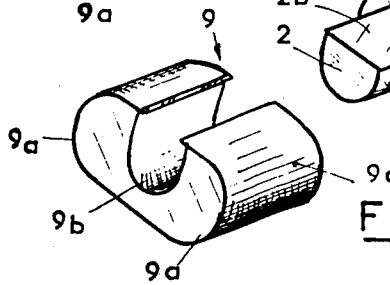
FIG.5
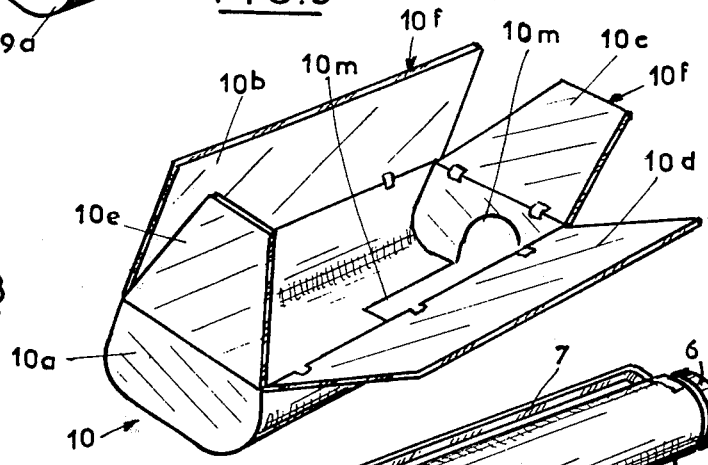
FIG.8
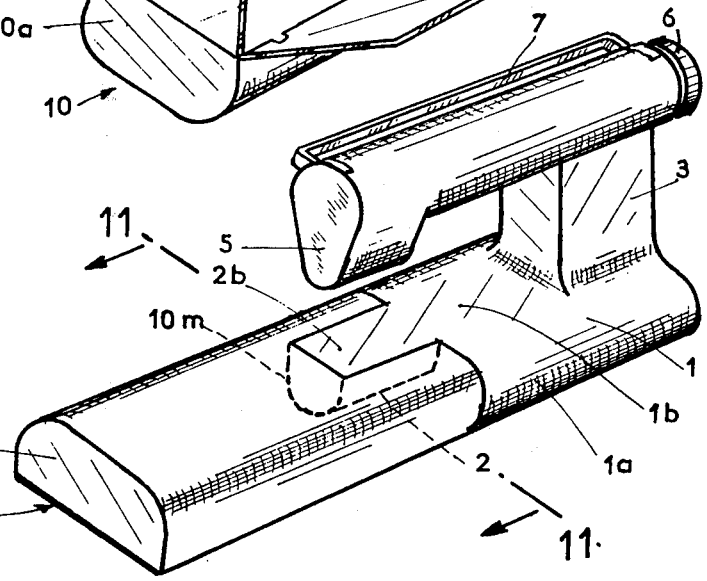
FIG.9

FIG.10
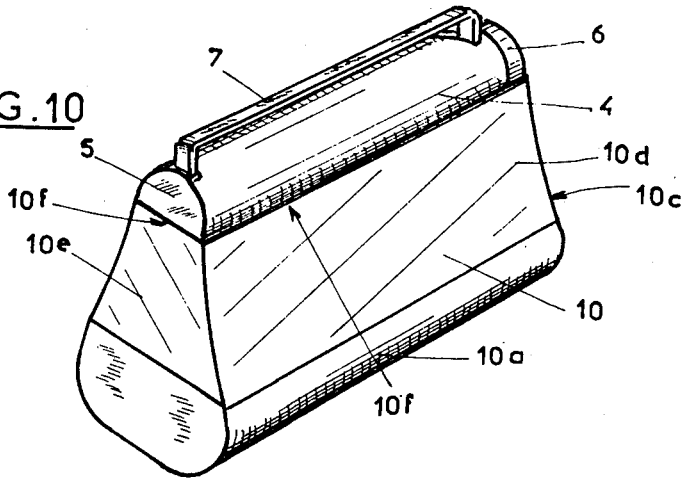
FIG.11
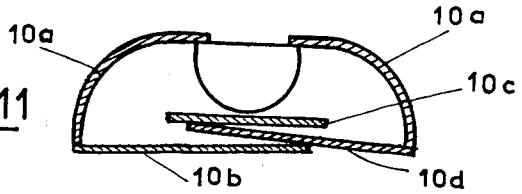
FIG.12
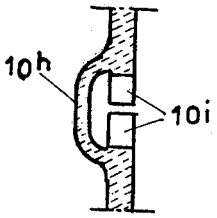
FIG.13
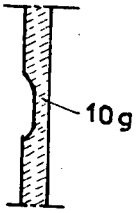
FIG.14
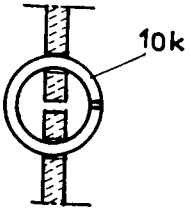
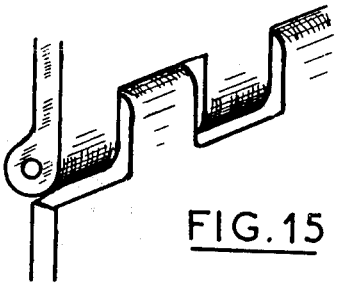
FIG.15
FIG.16
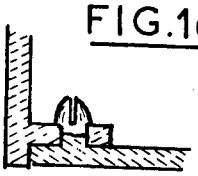

FIG. 19
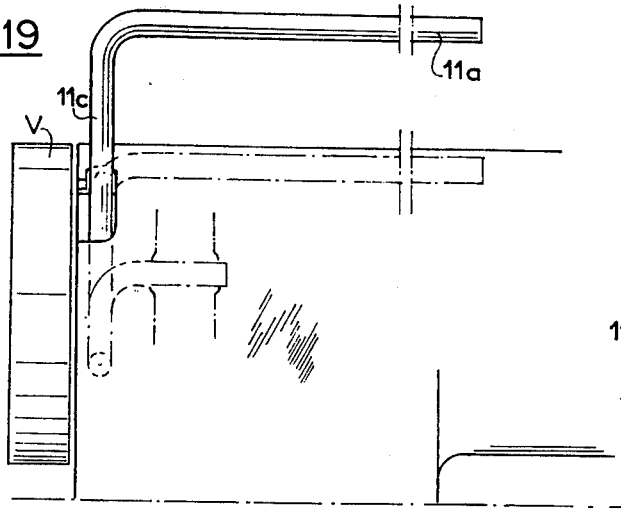
FIG. 20
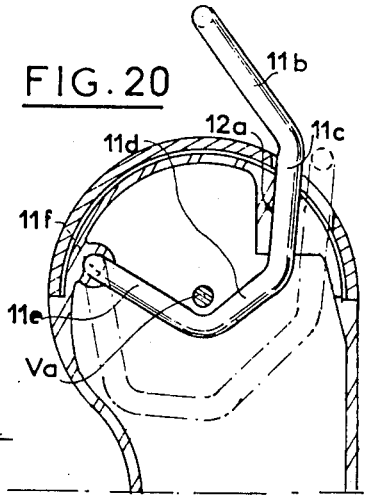
FIG. 21
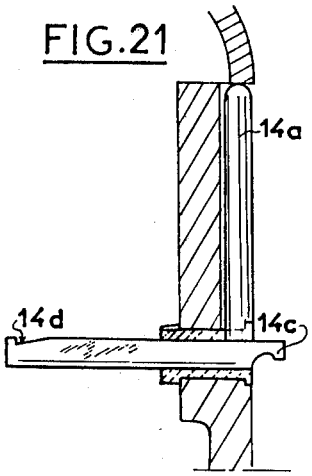
FIG. 22
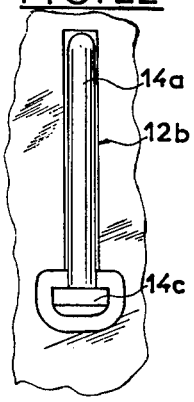
FIG. 23
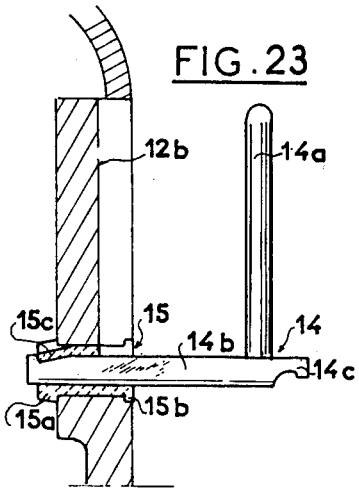
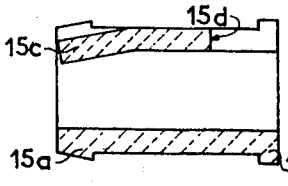
FIG. 24
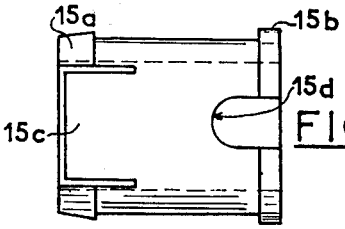
FIG. 25
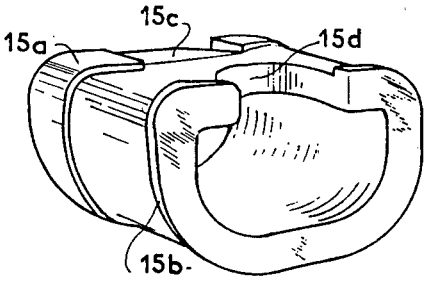
FIG. 26

SEWING MACHINE HAVING A DUAL-PURPOSE COMPLEMENTARY CASE

This application is a divisional application of Ser. No. 368,686, filed June 11, 1973.

FIELD OF THE INVENTION

The invention relates to a sewing machine including a dual-purpose complementary-shaped sewing machine case.

In effect, the invention comprises part of the technology concerned with sewing and embroidery equipment and equipment, such as sewing machines and the like, for similar work.

SUMMARY OF THE INVENTION

The sewing machine according to the invention is of the cantilever type designed so as to be compact, of light-weight, exceptionally functional, and of attractive appearance, while at the same time incorporating other significant practical advantages. The inventive sewing machine comprises a closely complementary-shaped fitted case of the "attache case" type, facilitating on the one hand the convenient conveyance of the machine and on the other hand, the removal thereof, when not utilized, with a minimum extent of bulk. During utilization of the machine, the case may be fastened by pivotal motion to a cantilevered free arm of the machine so as to form a large-dimensioned worktable.

The machine may also be equipped with an accessory-containing box adapted to be mounted onto the free arm of the machine, and which may be readily detached therefrom.

A further feature of the invention resides in the utilization of the case so as to comprise a base which is shaped and dimensioned to envelop the pedestal portion and the free arm of the machine, including four flaps protecting the upper edges of the base, and with the flaps being shaped and dimensioned so as to form a closed, protective space when the case is fitted about the machine for transport thereof. The case is further adapted to be detached from the machine and then replaced thereon in a manner whereby the base of the case, which has a recess therein corresponding to the shape and dimensions of the free arm, may be fitted about the free arm and constitute an extension of the free arm and of the pedestal of the machine, thereby creating a large-dimensioned working table.

According to a further feature of the invention, a pivoting handle is provided which is of an extremely simple design and extends substantially over half of the length of the sewing machine, at right angles to the vertical body portions thereof, and in such manner as to permit gripping loads to extend through the axis of the center of gravity of the sewing machine.

According to a further feature of the invention, a reel-holder is retractable into and completely engageable in the rear surface of the vertical portions of the machine, leaving a gripping portion projecting only a few millimeters from the machine frame. Thus, the sewing machine case generally conforms to the contour of the machine and is attached to the latter by means of tongues made from a synthetic material, the latter of which may preferably be a material having a predetermined degree of resilience, which are fastened to the lateral flaps of the case, and the ends of which have a stud adapted to penetrate into orifices formed in the upper portion of the frame of the sewing machine. Thus, due to this arrangement, there is achieved a precise positioning of the bottom of the machine on the bottom of the case, so as to allow for projection of the leg portions of the machine from the case bottom. The said tongues are also employed for maintaining the flaps retracted within the base portion of the case upon the latter being utilized as a work table.

BRIEF DESCRIPTION OF THE DRAWINGS

These and other features and objects of the invention will become more apparent from the description given hereinbelow in conjunction with the accompanying drawings, in which:

FIG. 4 is a perspective view of the embodiment of the machine of FIG. 1;

FIG. 5 is a perspective view of a box for accessories, adapted to be utilized with the machine illustrated in FIG. 4, and shown in alignment with the free arm onto which it is to be mounted;

FIG. 6 illustrates, in a perspective view, the box for accessories as mounted on the free arm of the machine;

FIG. 8 shows, in a perspective view, the complementary-shaped case adapted to be utilized with the sewing machine of FIGS. 1 to 4;

FIGS. 9 and 10 show in perspective views, respectively, the case mounted on the machine in the machine operative position and the case positioned on the machine in the transport or conveying position thereof;

FIG. 11 is a cross-sectional view through the case taken along the line 11—11 in FIG. 9, showing the case fastened to the machine in the operative position thereof;

FIGS. 12 to 16 illustrate various embodiments of articulating flexible flaps, showing the flaps engaged one within the other and with the case;

FIG. 19 is a fragmentary front view of the rear portion of the sewing machine of FIG. 18 with the folded position of the handle being shown in broken lines;

FIG. 20 is a left-hand view in section of FIG. 19;

FIG. 21 is a partially sectioned view of a reel-holder shown in the position in which it is retracted within the frame of the sewing machine;

FIG. 22 is a front view of the reel-holder of FIG. 21;

FIG. 23 is a partially sectional view of the reel-holder in the extended position in the sewing machine frame;

FIG. 24 is a sectional view of the resilient sheath in which the reel-holder is slidably secured;

FIG. 25 is a plan view of the resilient sheath of FIG. 24;

FIG. 26 is an enlarged perspective view of the resilient sheath;

DETAILED DESCRIPTION

Figure 1:
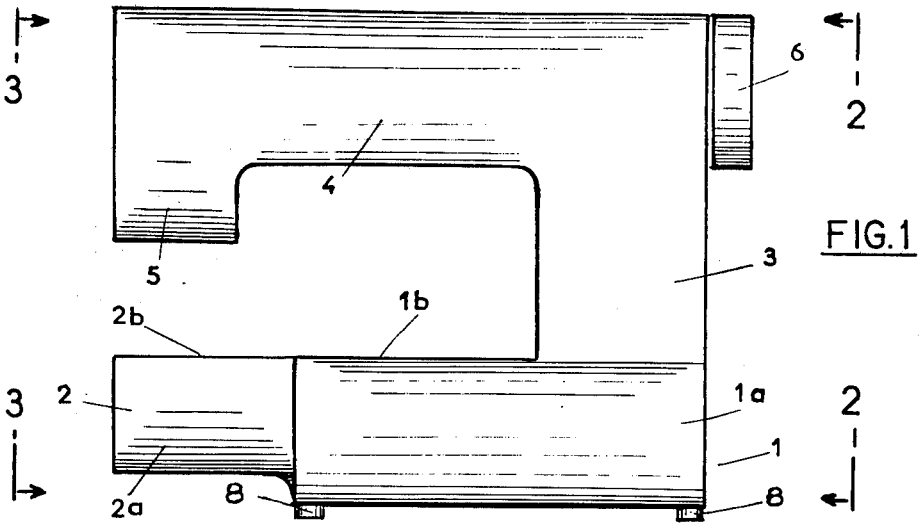
FIG. 1 is a front elevational view of an embodiment of the sewing machine.

The sewing machine comprises a pedestal or base 1, a free (cantilever) arm 2 extending forwardly of the pedestal 1, a vertical support member 3, an upper arm 4, a sewing head 5 and a hand wheel 6. The foregoing machine assembly may be constructed of one or more individual pieces and contains the sewing mechanisms, which need not be described in further detail since the sewing mechanisms, which may be of any known type or of novel type, do not fall within the scope of the invention.

According to the invention, having particular reference to the embodiment of FIGS. 1 to 4, the configurations of the various portions of the machine may be either round or comprise largely rounded and curved segments, in particular as applied (as illustrated) to the longitudinal sides 1*a* of the pedestal, to the lower portion 2*a* of the free arm 2, to the upper arm 4, and to the sewing head 5.

The upper surfaces 1*b* and 2*b* of the pedestal and of the free arm are aligned and are at least substantially coplanar. The width of the free arm is substantially smaller than the width of the pedestal.

Figure 3:
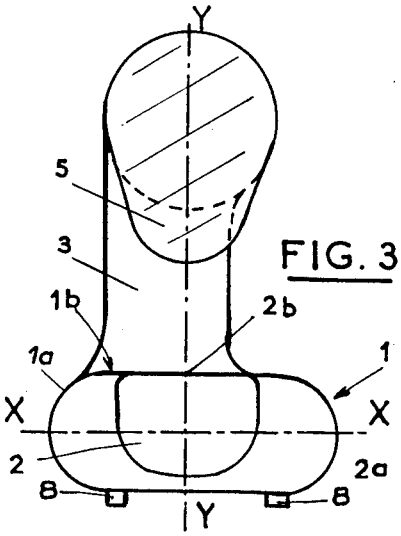
Figure 7:
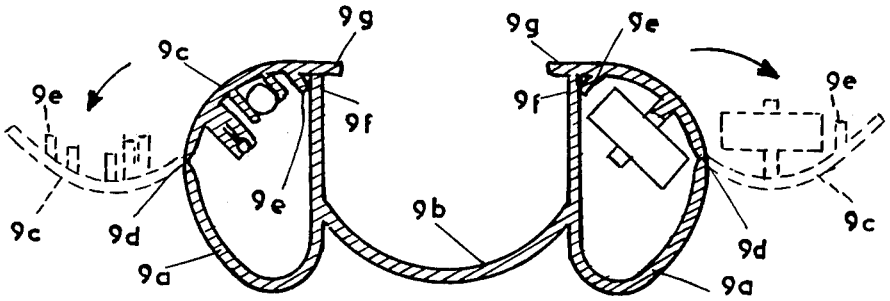
FIG. 7 shows, in an enlarged scale, a cross-section through the box for accessories, with the broken lines indicating the pivoting movements of the flaps thereon for affording access to the interior of the box.

The cross-sectional profile of the pedestal 1 is symmetrical relative to a horizontal median axis *x-x* with respect to its thickness (FIG. 3). This feature is important, due to the dual fitting or mounting capability of the case, as will be more apparent from the description given hereinbelow.

Figure 2:
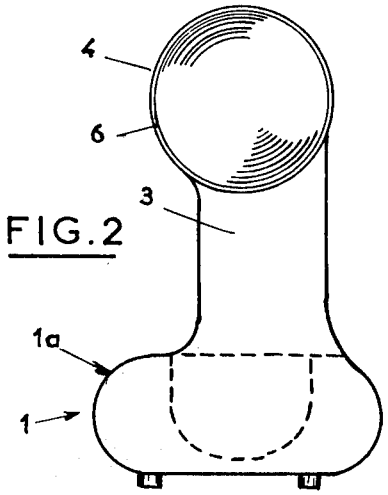
FIGS. 2 and 3 are front and rear end views of the machine, taken respectively along lines 2—2 and 3—3 of FIG. 1.

FIGS. 2 and 3 also show that, if the upper arm 4 and the sewing head 5 are symmetrically arranged relative to a vertical axis *y-y*, which is median in the cross-section of the pedestal 1, the vertical body 3 is located asymmetrically relative to the axis *y-y* so as to provide, on one side of the member 3, a larger opening for passage of the machine operators arm, having a wider support surface on the working plane 1*b* and an operative position which is more comfortable and more convenient for the operator.

The rounded or profiled configuration, such as the largely rounded portions of the upper arm 4, affords excellent manual gripping thereof, facilitating manipulation and transport of the sewing machine.

It is possible to provide the sewing machine, for example, along the arm 4 and the head 5, or only along a portion of the arm 4, with a suitable handle 7 which may be retracted by pivoting, sliding motion etc., in any known manner; or which may be made removable and adapted to be attached to the machine in any manner well known in the art.

Preferably, the lower portion of the pedestal or base is provided with legs 8 which may be made from rubber, felt, plastics or any suitable similar material.

The assembly of machine components 1, 2, 3, 4, 5 may be constituted of one or more pieces, and formed from injected metal, molded plastics or other material; or molded, injected, or possible machined material.

Within the framework of the invention, there is also provided a box 9 for accessories which is adapted to be fitted in a readily detachable manner about the free arm 2 of the machine, so as to form an extension of the working plane, and which provided with the necessary curves. Preferably, as illustrated in FIG. 6, the box 9 conforms in cross-section to the transverse profile of the pedestal 1 so as to form an extension thereof.

The box 9 is preferably made from metal, or molded or injected plastic material, and is shaped to have two utilizable interior spaces or compartments 9*a* which are of a configuration which is complementary to the cross-section of the free arm with respect to the cross-sectional profile of the pedestal. The compartments 9*a* are connected by one or more partitions 9*b* with reinforcing ribs.

The compartments 9*a* have pivoting flaps 9*c* articulated, for example, at 9*d* on hinge-lines of reduced thickness. Within the flaps or in the compartments, there may be formed, by molding or suitably attached, gripper members, supports or other positioning means.

The edge of the flaps 9*c* opposite the pivoting edge of hinge lines has, for example as illustrated, a tongue 9*e* for engagement with a lip 9*f*. The edge of the flaps is prolonged at 9*g* so as to provide a retaining slideway for supporting the box 9 on the free arm 2 as shown in FIG. 6.

According to the embodiment, if for example, the box is of a construction made from a flexible or resilient material, the box 9 may be fitted about the arm 2 at a predetermined degree of friction with respect to the compartments 9*a*, thus fixedly maintaining the box in a supported position on the free arm.

In addition from the usefulness thereof for receiving and storing various accessories, the box has the following advantages: — when it is fitted about the free arm, it extends the working plane or surface constituted by the pedestal and facilitates sliding movement of the fabric over the surface; — when the machine is utilized without mounting the case thereon as described further on hereinbelow, the box prevents any rocking of the machine upon large pressure or forces being exerted on the free arm during heavy operation of the machine; — the box provides, as desired, a sewing machine having a pedestal, when the box is in a mounted position, or a free-arm sewing machine, when the box is removed therefrom.

A dual-purpose complementary sewing machine case is shown in FIGS. 8 to 16. The case 10 comprises a base 10*a* which is shaped and dimensioned so as to envelop the pedestal 1 and the free arm 2, and also the box 9 when the box is mounted on the machine and fitted onto the free arm.

The base 10*a* is of dished shape and may be molded, or alternatively may be formed from a plate or sheet which is appropriately cut and the edges of which are then turned up.

The edges of the base 10*a* are extended by four flaps 10*b*, 10*c*, 10*e*, 10*e*. The flaps are designed and dimensioned so as to have substantially trapezoidal, planar or inwardly curved shapes, whereby contiguous edges are formed or, optionally, overlapping edges, when they are lifted up toward the sewing machine for transport of the latter (FIG. 10). Accordingly, the case forms a closed, protective space. The upper edges 10*f* of the flaps respectively bear at a tangetial relationship against the upper arm 4, the sewing head 5, and the hand wheel 6.

The articulation of the flaps 10*b*, 10*c*, 10*d*, 10*e* along the edges 10*a* is effected,, for example, along hinge-folds 10*g*, as illustrated in FIG. 13. In this case, the hinge-folds are constituted by thinning lines in the thickness of the material.

Referring to FIG. 12, the articulation of the flaps to the base 10*a* is effected by means of one or two connecting tongues 10*h*, having support and stop heels 10*i* restricting, in one direction, the pivoting of the flap relative to the base. The articulation of the flaps on the base may also be effected by means of a system comprising rings or helixes 10*k* (FIG. 14) or, alternatively, by hinge arrangements of a known type, as illustrated in FIG. 15. These arrangements are not limitative and are only shown by way of illustrative examples.

Furthermore, the positioning or connection of the flaps to each other or with respect to the case is effected, for example, as illustrated in FIG. 16, which shows a slotted finger having an enlarged end which is engaged under resilient pressure in an associated aperture.

The case is designed in a manner whereby:

the base 10*a* is dimensioned so that the flaps 10*b*, 10*c*, 10*d*, 10*e* may be turned down and withdrawn within the base when the case is pivoted so as to be utilized as a work table, as shown in FIG. 9;

the base 10*a* is cut at the bottom and on one side (at 10*m*) so as to permit fitting about the free arm 2 when the case is pivoted in order to be utilized as a work table (FIG. 9). In this instance, as seen in FIG. 11, the turned-down flaps 10*b*, 10*c*, 10*d*, 10*e* are positioned within the base 10*a* and under the free arm.

The case may be made from any metal, sheet metal, plastic material, or material having similar suitable properties.

The significance and advantage of the present sewing machine case, which facilitates both transporting or storage of the machine under conditions affording good protection (FIG. 10) and also adaptation after pivoting, so as to form a large-surfaced worktable which is practical and convenient, is readily understood.

It is also possible that one or more of the flaps 10*b*, 10*c*, 10*d*, 10*e* may be extended through articulated, rigid, semi-rigid or flexible portions, for the purpose of completely covering the sewing head, the upper arm and the hand wheel of the sewing machine. In that instance, the extending portion or portions may carry a handle in a direct supporting relationship.

According to the embodiment shown in FIGS. 17, 18, 19 and 20, the gripping or carrying handle 11 is mounted so as to articulate in the frame 12, comprising a rectilinear portion 11*a* extending longitudinally and parallel to the upper portion 13*a* of the arm 13 of the sewing machine and over approximately one-half of its length, whereby the user's hand, during transport of the machine, is located to the right of the center of gravity of the sewing machine. The handle 11 has, in extension of the rectilinear portion 11*a*, a right-angled portion 11*b* inclined relative to the horizontal axis so that the rectilinear portion 11*a* is located within the horizontal axis of the machine when the handle is in the extended position and a pivot or crank portion 11*c* extending from the portion 11*b* contacts, along one of its generatrices, the horizontal face 12*a* of an aperture formed in the frame 12, which is slightly offset relative to the axis of the machine, thereby permitting free passage therethrough of the handle 11. The handle 11 includes two portions 11*d* and 11*e* which are located in the same plane as the portions 11*b*, 11*c*. and adapted to be appropriately pivoted so that the handle 11 is located therebelow and permits free passage for the shaft V*a* of a handle V. The squared end 11*f*, located in parallel to the portion 11*a*, constitutes an articulation pivot for the handle 11 and is disposed within an aperture formed in a boss on the frame 12.

Figure 17:
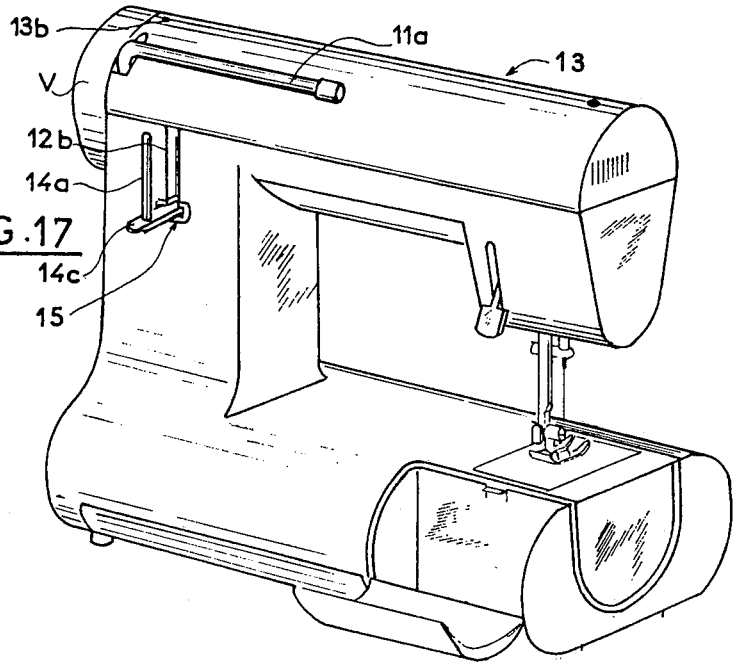
FIG. 17 is a perspective elevational rear view of a further embodiment of a sewing machine.
Figure 18:
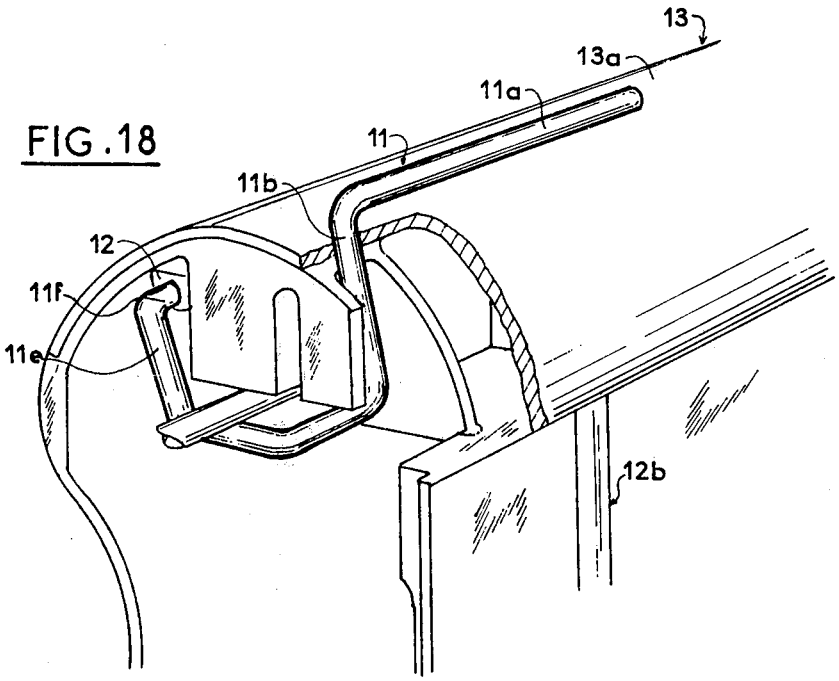
FIG. 18 is an enlarged perspective and partially sectioned view of the rear portion of the sewing machine of FIG. 17 with the flap havng been removed.

In the folded position illustrated in FIG. 17, only the rectilinear portion 11*a* of the pivoting grasping handle 11 is visible, whereas in the extended position thereof shown in FIGS. 19 and 20, the portions 11*a* and 11*b* project from the arm 13 of the machine.

The retractable reel holder 14 shown in FIGS. 17, 21, 22, 23, 24, 25 and 26 comprises a vertical pivot 14*a* adapted to receive a reel, and which is secured perpendicular on a slide member 14*b* sliding and fastened into position within a sheath 15 made from any appropriately suitable plastic material. The side member 14*b* provides, in the withdrawn position thereof, a gripping portion 14*c* projecting from the frame 12, and having formed therein a notch affording improved grippability. The sheath 15, which is slightly conical so as to permit force-fitted engagement thereof, is maintained by two shoulders 15*a* and 15*b* which lock it against longitudinal translation, and also by relative resilience imparted thereto by appropriate choice of plastic material. A tongue 15*c* formed at one end of the sheath 15 and projecting into the sheath engages in a notch 14*d* formed in one end of the slide member 14*b*, thereby forming a stop for the reel-holder 14 when the latter is in an extended position. When the reel-holder 14 is in a retracted position, the tongue 15*c* is retracted due to the resilience provided by its plastic material properties, and abuts against the upper face of the slide member 14*b*. The pivot 14*a* takes up its position in a recess 12*b* formed in the frame 12. A recess 15*d* is also formed in the sheath 15 for permitting passage of the pivot 14*a*. Thus, when the reel-holder 14 is in the withdrawn position, the gripping portion 14*c* continues to project.

Figure 27:
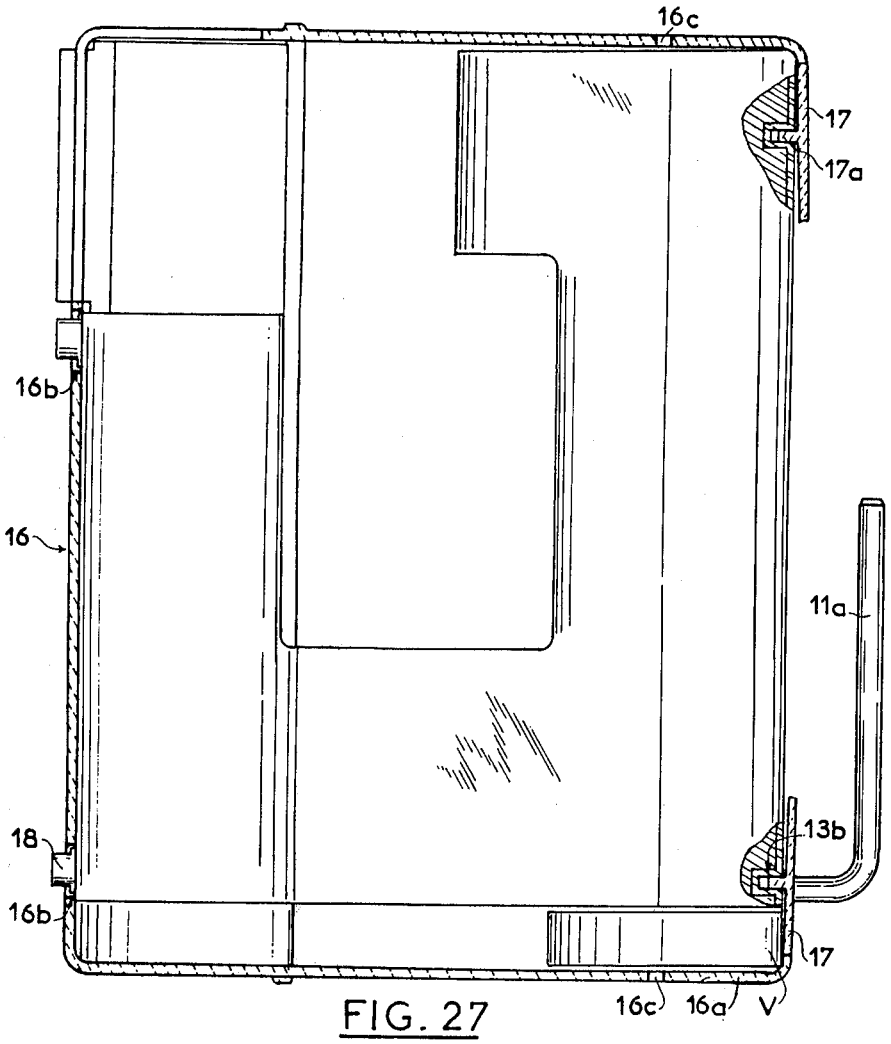
FIG. 27 is a front view, in section, of the assembled sewing machine and case.
Figure 28:
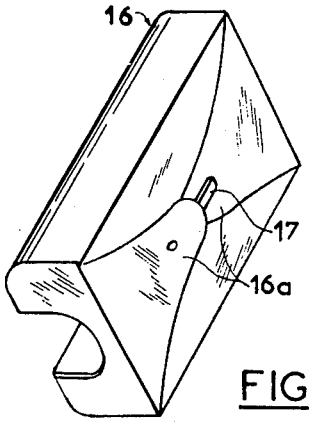
FIG. 28 is a perspective view of the case in the closed position adapted to be utilized as a work table.
Figure 29:
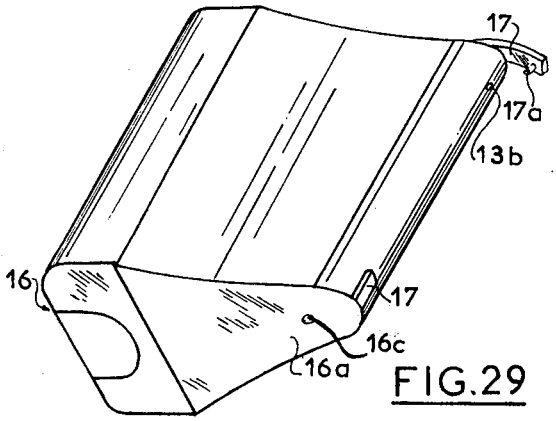
FIG. 29 is a perspective view of the sewing machine positioned within its transport case.

As shown in FIGS. 27, 28 and 29, the case 16 utilized for transporting the sewing machine is secured by at least two tongues 17 made from any material providing a predetermined suitable degree of resilience.

The tongues 17 are secured to the upper portion of the lateral flap 16*a* of the case 16 and have studs 17*a* penetrating into orifices 13*b* appropriately formed in the upper portion of the arm 13.

Thus, when the tongues 17 are turned down on the arms 13, the studs are engaged in the orifice 13*b*, and the resilience of the tongues 17 presses the lower portion of the sewing machine against the bottom inner surface of the case, thereby permitting projection of the legs 18 of the machine through the orifice 16*b* formed in the base of the case 16. The tongues 17 are also utilized for maintaining the flaps 16*a* in the position in which they are turned-down or folded in within the base of the case 16 when the latter is utilized as a work table. In that instance, the studs 17*a* of the tongues 17 together with the upper flap 16*a* engage in the orifice 16*c* formed in the additional flap.

While there has been shown what is considered to be the preferred embodiment of the invention, it will be obvious that modifications may be made which come within the scope of the disclosure of the specification.

What is claimed is:

1. The combination of a sewing machine and a dual-purpose complementary case, said machine comprising components including a pedestal, a cantilever arm projecting horizontally from said pedestal, a vertical body extending upwardly from said pedestal, an upper arm extending horizontally from said vertical body at a level above said pedestal, and a head on said upper arm disposed above said cantilever arm, said components having generally curvedly and largely rounded portions, said pedestal having a transverse cross-sectional shape which is symmetrical in thickness relative to a horizontal median plane therethrough, said cantilever are extending from said pedestal in the lengthwise direction thereof and being of reduced width relative to said pedestal, said cantilever arm and head being symmetrically located with respect to a common vertical plane, said cantilever arm having an upper planar surface forming a substantially coplanar extension with the upper surface of said pedestal, said case comprising a base defining an enclosure having an open mouth, said base being shaped in correspondence with said pedestal to fittingly receive the same and said cantilever arm therein, a plurality of flap means hingedly connected to said base at said open mouth for undergoing inward pivotal movement to engage said upper arm and head and substantially enclose the same and said vertical body to form a protective closure therefor for transport of said machine, said case being removable from said machine and said flap means being foldable to a position within said enclosure, said case having aperture means for penetration of said cantilever arm therein with the case inverted from the position in which said case fittingly receives said pedestal, said base in said inverted position forming an extension of said upper surface of said cantilever arm and of said pedestal to provide a large work surface.

2. The combination as claimed in claim 1, comprising a pivotable, slidable, and detachable handle mounted on said upper arm of said machine.

3. The combination as claimed in claim 1, wherein said machine comprises a hand wheel extending from said upper arm adjacent said flap means including vertical body, said flaps having upper edges bearing respectively, against the upper arm, the head and the hand wheel.

4. The combination as claimed in claim 1, comprising latching means for engaging said flap means to said upper arm.

5. The combination as claimed in claim 4, wherein said latching means comprises tongues on said flaps means, said tongues having projecting studs, said upper arm having recesses for said studs.

6. The combination of a sewing machine and a dual-purpose complementary case, said machine comprising components including a pedestal, a cantilever arm projecting horizontally from said pedestal, a vertical body extending upwardly from said pedestal, an upper arm extending horizontally from said vertical body at a level above said pedestal, and a head on said upper arm disposed above said cantilever arm, said components having generally curvedly and largely rounded portions, said pedestal having a transverse cross-sectional shape which is symmetrical in thickness relative to a horizontal median plane therethrough, said cantilever arm extending from said pedestal in the lengthwise direction thereof and being or reduced width relative to said pedestal, said cantilever arm and head being symmetrically located with respect to a common vertical plane, said cantilever arm having an upper planar surface forming a substantially coplanar extension with the upper surface of said pedestal, said case comprising a base defining an enclosure having an open mouth an flaps hingedly mounted on said base around said open mouth, said base having a cross-sectional shape conforming to the shape of said pedestal such that in a first position of said case said pedestal can be fitted in said case and said flaps can be folded inwardly to form a closed protective space for transport of the machine, said case being removable from the machine and inverted to a second position, said case having opening means conforming to the shape of the cantilever arm for insertion of said cantilever arm into said opening means in said second position of said case such that said base forms a continuous extension of the upper surface of said cantilever arm and of said pedestal to form a large surface work table.

7. The combination as claimed in claim 6, comprising a pivotable, slidable, and detachable handle mounted on said upper arm of said machine.

8. The combination as claimed in claim 6, wherein said machine comprises a hand wheel extending from said upper arm adjacent said vertical arm, said flaps having upper edges bearing, respectively, against the upper arm, the head and the hand wheel in said first position of said case.

9. The combination as claimed in claim 6, wherein in said second position of said case said flaps folded inwardly into said base.

10. The combination as claimed in claim 6, comprising latching means for engaging said flaps to said upper arm in said first position of said case.

11. The combination as claimed in claim 10, wherein said latching means comprises tongues on said flaps, said tongues having projecting studs, said upper arm having recesses for said studs.

* * * * *